United States Patent [19]

Milner

[11] Patent Number: 4,687,457

[45] Date of Patent: Aug. 18, 1987

[54] HAND-HELD PUPPET WITH PSEUDO-VOICE GENERATION

[75] Inventor: Ronald E. Milner, Grass Valley, Calif.

[73] Assignee: Axlon, Inc., Sunnyvale, Calif.

[21] Appl. No.: 769,116

[22] Filed: Aug. 26, 1985

[51] Int. Cl.[4] ..... A63H 3/28

[52] U.S. Cl. ..... 446/175; 446/303; 446/329

[58] Field of Search ..... 446/175, 297, 298, 300, 446/301, 303, 329, 327, 397; 40/455, 457; 352/87

[56] References Cited

U.S. PATENT DOCUMENTS

| | | | |
|---|---|---|---|
| 3,274,729 | 9/1966 | Refabert | 446/175 X |
| 4,221,927 | 9/1980 | Dankman et al. | 446/297 X |
| 4,294,035 | 10/1981 | Klein | 446/397 |
| 4,314,423 | 2/1982 | Lipsitz et al. | 446/303 |
| 4,551,114 | 11/1985 | Hyman et al. | 446/397 |

*Primary Examiner*—Mickey Yu

*Attorney, Agent, or Firm*—Townsend and Townsend

[57] ABSTRACT

A hand-held puppet of the type configured to represent a living being, and having hand-controllable moving parts to simulate some form of animation, is provided with sound-generating apparatus operable in response to the hand-controlled animation simulation. The sound-generating apparatus includes a sensor that produces a signal in response to animation-producing movement of the hand-controllable parts, a circuit for producing a tone having a pseudo-randomly varying audio frequency, and a modulator that modulates the sensor-produced signal with the varying frequency tone to produce a sound signal that, when applied to a speaker mechanism, provides sound coordinated to hand-controlled animation of the puppet.

20 Claims, 3 Drawing Figures

HAND-HELD PUPPET WITH PSEUDO-VOICE GENERATION

BACKGROUND OF THE INVENTION

The present invention is directed to hand puppets. More specifically, the invention is directed to generating sound such as, for example, simulated voice, in response to the hand-controlled simulation of animation of a hand puppet.

Hand puppets have long delighted children and adults alike for generations, and have taken a variety of forms and constructions. One popular type of puppet construction, and one to which this invention is primarily directed, takes the form of a creature of one form or another, such as a duck, gorilla, or the like. Hand-operable parts may be provided the hand puppet for limited animation, with some form of access to the interior for insertion of a person's hand. Manipulation of the hand-operable parts gives the puppet animation—usually in the form of jaw movements that simulate vocalization.

SUMMARY OF THE INVENTION

The present invention provides sound-generating apparatus for use in conjunction with a hand puppet of the type having hand-movable parts simulating animation to provide controllable sound that is coordinated with hand-operable animation of the puppet. Broadly, the invention includes a sensor mounted to detect movement of the movable parts to produce a signal that is modulated, in part, by the detected animation-producing movement. The signal is combined, through a modulation process, with an audio frequency tone. The result is a modulated audio signal that, when applied to a speaker, produces sound controllable by hand movements and coordinated to the animation of the puppet.

In the preferred embodiment of the invention a sensor in the form of a light-sensitive photocell is mounted in the puppet's mouth to allow hand-controlled animation of the puppet to vary the light received by the photocell to produce a signal indicative of mouth movement by detecting changes in light. A frequency generator, including a voltage-controlled oscillator responsive to a voltage derived from the output of a counter, produces a tone signal having a pseudo-randomly varying frequency in the audio range. The tone signal is applied to a modulator and used to modulate the signal produced by the photocell, resulting in an audio signal having a pseudo-randomly varying pitch component and an amplitude that is variable by hand movements and coordinated with animation of the puppet. When applied to an electromechanical conversion device (i.e., speaker), a pseudo-articulate sound is produced.

A supply voltage control circuit produces the operating voltage for the electronic circuits used to implement the invention. The control circuit is structured to respond to the signal produced by the sensor so that if no light changes are sensed by the photocell for more than a certain period of time, the operating voltage is terminated.

Finally, the invention incorporates a one-shot and a high Q filter to produce modulation signals that result in sound simulating quacking, barking, and the like.

A principal advantage provided by the present invention is found in the realism afforded a child's toy or other amusement device having movable parts to simulate animation. With the present invention a user can produce a controllable sound that is coordinated with a movement of the toy or device. In the case of hand puppets of the type to which the preferred embodiment of the invention is directed, the sound would be coordinated with some form of animation.

A further advantage is obtained by producing a sound having a randomly-varying audio frequency content. While the amplitude of the sound produced can be controlled, to some extent, by the person manipulating the puppet, the tone or pitch of that sound is not controllable, thereby providing a toy or other device with a "personality."

Still another advantage of the present invention is the simplicity of the circuitry used to generate a synthetic voice in response to opening a puppet's mouth manually. Thereby, a relatively inexpensive puppet with realistic animation is provided.

These and other features and advantages of the present invention will become apparent to those skilled in the art upon a reading of the following detailed description of the invention, which should be taken in conjunction with the accompanying drawings.

DETAILED DESCRIPTION OF THE INVENTION

Figure 1:
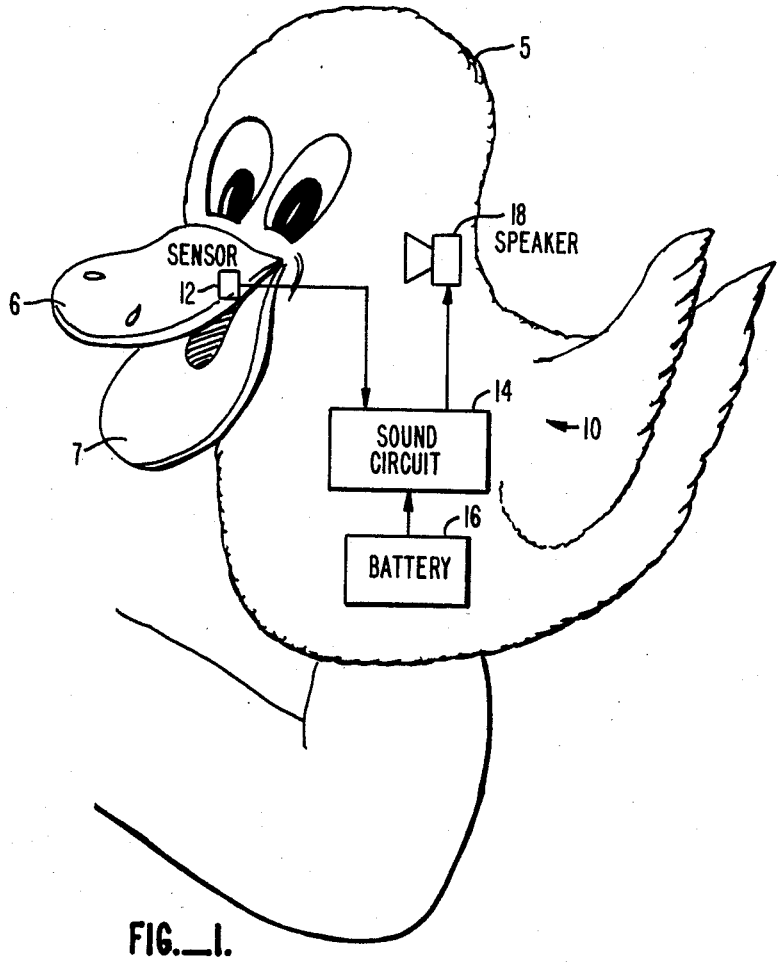
FIG. 1 is a simplified block diagram of the present invention illustrating its use with a hand puppet.

Illustrated in FIG. 1 is a representative use of the present invention. As shown, the invention, generally designated with the reference numeral 10, is included in a hand puppet 5, illustrated here as being of the type shaped and configured to represent a duck-like creature. The hand puppet 5 is structured to have an internal recessed area (not shown) accessible by a person's hand (not shown) so that movable parts 6, 7, shaped like a duck's bill, can be manipulated by the person's hand (not shown) to simulate animation.

The sound generator 10 incorporated in the hand puppet 5 is shown as including a sensor 12 mounted at a location that permits detection of movement of the movable parts 6, 7. As will be seen, a photocell 22 (FIG. 2) forms a part of the sensor 12. Thus, the photocell 22 would be mounted so that movement of movable parts 6, 7 will expose the photocell to varying intensities of light.

The sensor is configured, to respond to movement of movable parts 6, 7 producing a signal that is applied to a sound circuit 14. The sound circuit 14 operates from a voltage produced by a battery-operated voltage supply circuit 16 to produce an audio signal that is converted to sound by a speaker 18. The signal produced by the sensor 12 controls the amplitude of the audio signal applied to the speaker 18. A tone-generating circuit, included in the sound circuit 14, produces an audio frequency tone signal that is used to modulate the sensor-produced signal. Thus, as one manipulates the hand-movable parts (i.e., duck bill) 6, 7, sound emanates from the speaker 18 that is coordinated with the movements, enhancing the realism of the hand puppet 5.

Figure 2:
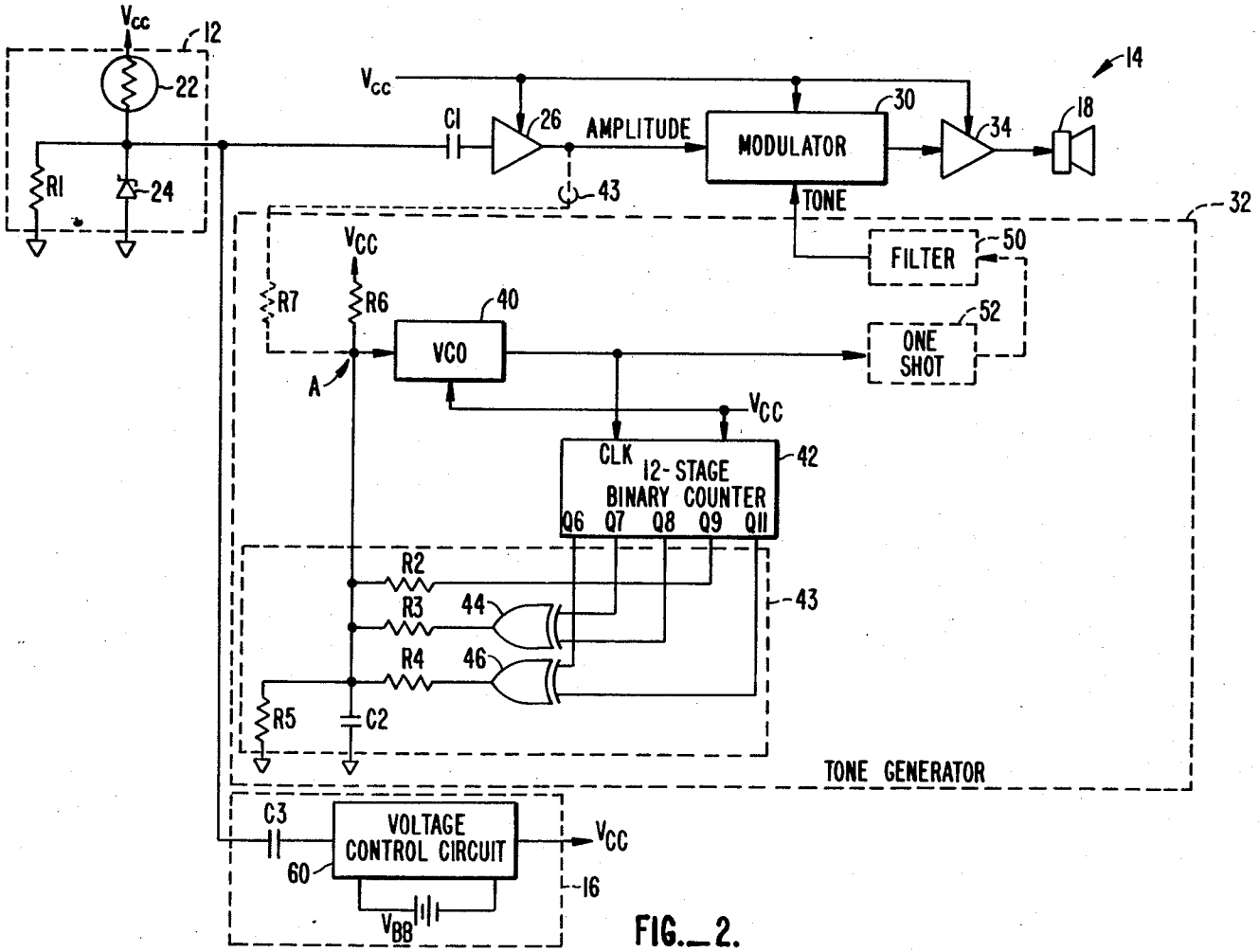
FIG. 2 is a detailed block diagram of the electronic circuit forming the present invention.

Referring now to FIG. 2, the sound generator 10 is shown in greater detail. The sensor 12 is illustrated as including a cadmium sulfide (CdS) photocell that is connected to an operating voltage $V_{cc}$ and biased by the parallel connection of a zener diode 24 and resistor R1 to provide a dynamic impedance over a wide range of operating levels. The sensor 12 is capacitively coupled, by the capacitor C1, to an amplifier 26 contained in sound circuit 14. Use of the coupling capacitor C1 ensures that the sound circuit 14 is sensitive to variations in light falling on the photocell 22 (due to the movement of the hand puppet's bill, formed from movable parts 6, 7) rather than absolute levels of light due to room illumination.

The signal variations received by the amplifier 26 are amplified and applied as an AMPLITUDE signal to an input of a modulator circuit 30. The modulator circuit 30 can take various forms such as, for example, a single-pole, single-throw solid-state switch (not shown) controlled by a TONE signal produced by a tone generator 32.

The output of the modulator circuit 30, an audio signal whose envelope is determined by the AMPLITUDE signal, and whose frequency content is dictated by the TONE signal, is amplified by an amplifier 34, applied to the speaker 18, and converted to sound.

The TONE signal used to modulate the AMPLITUDE signal can take on various forms. In the preferred embodiment, the sound that emanates from the speaker 18 is meant to simulate voice. To do so, the tone signal, which dictates the pitch of the voice simulation produced, has a frequency content that varies in a somewhat pseudo-random fashion. Accordingly, the tone generator 32 includes a voltage-controlled oscillator (VCO) 40 that receives a varying voltage produced at a voltage node A. The heart of the tone generator 32, however, is a 12-stage binary counter configured by EXCLUSIVE-OR gates 44 and 46 which form, with resistors R2, R3 and R4, a feedback circuit 43.

As FIG. 2 further illustrates, the output of the VCO connects to the clock (CLK) input of the binary counter 42, driving that counter through its respective counts. A capacitor C2, connected between the voltage node A and a ground potential, functions to smooth the voltage changes appearing at voltage node A in order to slew the VCO voltage rather than jumping it.

As the binary counter 42 operates, stepping sequentially through its individual states in response to the square wave clock signal produced by the VCO 40, the logic states of the outputs Q6–Q11 will change accordingly. Although the sequential states assumed by the outputs Q6–Q11, as a group, are assumed in a sequence, this sequence is not seen at the voltage node A. To the contrary, the EXCLUSIVE-OR gates 44, 46, and resistor R2 perform the two-fold function of "scrambling" that sequence as it is coupled to the voltage node A and converting the scrambled sequence from digital to an analog voltage. The result is that the voltage at voltage node A varies in a pseudo-random fashion. A capacitor C2, connecting the voltage node A to a ground potential, smooths the transitions experienced at the voltage node.

Illustrated in phantom in FIG. 2 is an alternative that can be used to supplement the 12-stage counter 42, replace the counter, or to determinately vary the voltage level at the voltage node A. As illustrated, an interconnection 43, including a resistance R7 couples the AMPLITUDE signal produced by the amplifier 26 to the input of the VCO 40. When used to replace the binary counter 42, and its associated circuitry (i.e., EXCLUSIVE-OR gates 44, 46), the frequency content of the TONE signal generated by the VCO 40 would vary with light changes detected by the photocell 22. The user, then, would be able to affect both the amplitude and the pitch of the sound produced by manipulation of the moving parts 6, 7. When used as a supplement to the binary counter 42 (and associated circuitry) the AMPLITUDE signal is summed at the voltage node A with the voltage developed by the binary counter 42 through the EXCLUSIVE-OR gates 44, 46 and resistor R2.

Using the TONE signal generated by the VCO 40, and applying it directly to the modulator 30 as the TONE signal, will produce a sound that simulates voice. However, for more exotic sounds such as, for example, duck-like quacking or frog-like croaking, there may be provided a high Q filter 50 that is excited by pulses produced by a one-shot 52. The pseudo-randomly varying square wave output of the VCO 40 is applied to the one-shot 52 to produce periodic pulses. The periodic pulses, when applied to the filter 50 produce a ringing effect, due to the high Q of the filter. When the one-shot is configured to produce pulses (in response to the signal produced by the VCO 40) with a pulse-reoccurrence-frequency (PRF) of approximately 200 Hz and a pulse width of approximately 0.5 milliseconds, a passable frog-croak can result. Alternatively, with approximately the same pulse width and a PRF of about 500 Hz, a reasonably good duck-like quacking can be produced. In either case, the Q of the filter 50 is in the range of 10–20.

The output signal produced by the photocell 22 is also applied to the voltage supply circuit 16, which is shown as including a supply voltage control circuit 60 and a battery $V_{BB}$. A coupling capacitor C3 couples the voltage variations produced by the photocell 22 to the voltage control circuit 60.

Figure 3:
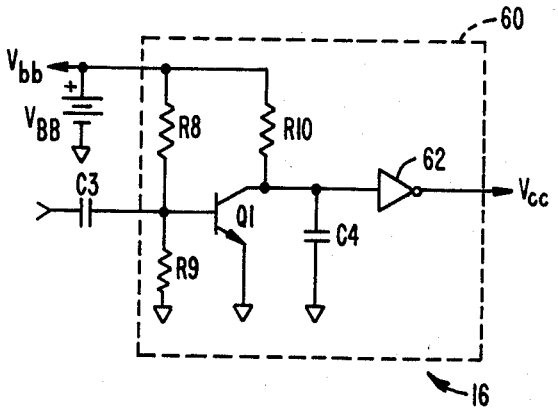
FIG. 3 is a schematic diagram of the supply voltage control circuit used to supply an operating voltage for the electronics of the block diagram of FIG. 2.

The voltage supply circuit 16, which is illustrated in greater detail in FIG. 3, functions to supply the operating voltage $V_{cc}$ for a predetermined time (2–5 seconds) after any voltage variation is produced by the photocell 22. Approximately 2–5 seconds after the last of any such voltage variation, the voltage control circuit 60 will terminate the supply voltage $V_{cc}$, thereby preserving the charge stored on the battery $V_{BB}$.

As shown in FIG. 3, the voltage control circuit 60 includes a bias circuit comprising series-connected resistors R8 and R9 connected between the battery $V_{BB}$ and ground potential, and to the base lead of a transistor Q1. The ratio of the resistance of resistor R8 to that of resistor R9 is chosen so that, under quiescent conditions, the transistor Q1 is held in a cut-off (non-conducting) state.

A collector resistor R10 connects the collector lead of the transistor Q1 to the positive terminal of the battery $V_{BB}$ and forms, with the capacitor C4, a timing circuit. The collector lead of the transistor Q1 is also connected to one input of an INVERTER 62. The output of the INVERTER 62 provides the supply voltage $V_{cc}$.

The coupling capacitor C3 operates in the same manner as the coupling capacitor C1, ensuring that only voltage variations are seen at the base lead of the transistor Q1. Under quiescent conditions, with the transistor Q1 held in cut-off by the bias resistors R8 and R9, the capacitor C4 is charged to a voltage approximately equal to that of the battery $V_{BB}$. Under this condition, the output of the INVERTER 62, the supply voltage $V_{cc}$, is approximately zero volts. When, however, the photocell 22 experiences a variation in light, the voltage level at the junction between the zener diode 24 and the photocell 22 will vary, which variation is coupled, by the coupling capacitor C3 to the base lead of the transistor Q1. The positive-going portion of the voltage variation will cause the transistor Q1 to conduct for a short period of time sufficient to discharge the capacitor C4 (through the low impedance path presented while the transistor Q1) conducts. If the capacitor C4 discharges to a voltage level below the threshold voltage of the INVERTER 62, i.e., approximately zero volts, as it usually will in response to any such variation, the output of the INVERTER 62 becomes a logic HIGH, and the operating voltage $V_{cc}$ is brought into existence to place the sound generator 14 in an operating condition.

When the voltage variations produced by the photocell 22 cease, the transistor Q1 will be brought back into a cut-off condition by the bias resistors R8 and R9. Capacitor C4 will charge (preferably relatively) slowly to hold the sound generator 14 in an operative state for 2–5 second longer) until the threshold voltage of the INVERTER 62 is exceeded, causing the output of the INVERTER to assume a logic LOW, and terminating the supply voltage $V_{cc}$. In the preferred embodiment, the value of the resistance R10 is approximately 10 megohms, while the capacitor C4 is 0.47 microfarads.

While the above provides a full and complete disclosure of the preferred embodiment of the invention, various modifications, alternate constructions and equivalents may be employed without departing from the true spirit and scope of the invention. For example, various additional switches may be employed to selectively couple one of the twelve outputs of the binary counter 42 to the modulator 30 (via the switch SW1), or to the one-shot/filter combination, in place of the square wave signal produced by the VCO 40, producing a selective variety of sounds. Additionally, an alternative implementation of the sensor construction 12 would be to use a mechanical mechanism to rotate, for example, a potentiometer that senses relative movement of the movable members 6, 7.

Therefore, the above descriptions and illustrations should not be construed as limiting the scope of the invention, which is defined by the appended claims.

I claim:

1. In a hand-operated puppet of the type having a hand-movable part to simulate animation, sound-generating apparatus coordinated for operation with said animation to produce an audio signal capable of being converted to sound by transducer means mounted in the puppet, the sound-generating apparatus comprising:

sensor means mounted in association with the hand-movable part to produce a first signal having an amplitude that is varied by movement of the hand-movable part;

generating means for producing a tone signal; and modulator means coupled to receive and combine the first and the tone signals, producing therefrom the audio signal.

2. The sound-generating apparatus of claim 1, wherein the sensor includes a photocell mounted to detect light variations caused by said animation.

3. The sound-generating apparatus of claim 1, wherein the modulator means includes means for providing the audio signal with an amplitude determined substantially by the first signal and a frequency determined substantially by the tone signal.

4. The sound-generating apparatus of claim 1, the generating means including a multi-vibrator means for producing pulses.

5. The sound-generating apparatus of claim 4, the generator means including filter means coupled to the multi-vibrator means to produce the tone signal.

6. The sound-generating apparatus of claim 1, including power control means responsive to the first signal for producing a supply voltage for a predetermined period of time.

7. The sound-generating apparatus of claim 6, wherein the generating means and the modulating means are placed in an operable condition by the supply voltage.

8. The sound-generating apparatus of claim 1, the generating means including means for providing the tone signal with a pseudo-randomly varying frequency component.

9. In a hand puppet of the type including hand-operable means for simulating animation, a sound generator mounted in association with the hand-operable means to produce an audio signal from which sound can be produced in response to and coordinated with the animation, the sound generator comprising:

sensor means coupled to produce an amplitude signal in response to said animation, the amplitude signal having an amplitude that varies with movement of the hand-operable means;

circuit means operable to produce a tone signal;

modulator means coupled to the sensor means and to the circuit means to produce the audio signal by modulating the amplitude signal with the tone signal.

10. The sound generator of claim 9, wherein the circuit means includes a voltage-controlled oscillator for producing the tone signal.

11. The sound generator of claim 10, including frequency generating means coupled to the voltage-controlled oscillator for producing a pseudo-randomly varying signal, the voltage-controlled oscillator being responsive to the pseudo-randomly varying signal to produce the tone signal.

12. The sound generating means of claim 11, wherein the frequency generating means includes counter means.

13. The sound generator of claim 10, including means coupling the amplitude signal to the voltage-controlled oscillator, the voltage-controlled oscillator being responsive to the amplitude signal to vary the tone signal as a result of changes in the amplitude signal.

14. The sound generator of claim 9, including power control means adapted to couple a supply voltage to the circuit means and to the modulator means for a predetermined time upon detection of presence of the first signal.

15. A method of producing a voice-like sound in response to hand-operable generation of animation of a hand-operated apparatus configured to represent at least a portion of a creature, the method comprising the steps of:

producing an amplitude signal in response to, and having an amplitude that is varied by, the hand-operable generation of animation of the creature portion;

providing a tone signal;

modulating the amplitude signal with the tone signal to produce an audio signal; and converting the electrical audio signal to sound.

16. The method of claim 15, wherein the tone signal has a pseudo-randomly varying frequency content.

17. The method of claim 15, including the step of:

activating a supply voltage in response to variations of the amplitude signal.

18. The method of claim 17, wherein the supply voltage is activated for a predetermined period of time.

19. The method of claim 15, including the step of providing a photosensor means in association with the hand-operable apparatus to produce the amplitude signal.

20. The method of claim 19, wherein the photosensor means is operable to receive light that is varied by the animation.

* * * * *